US010787858B1

(12) United States Patent
Strother

(10) Patent No.: US 10,787,858 B1
(45) Date of Patent: Sep. 29, 2020

(54) WINDOW SHUTTER

(71) Applicant: Daniel Strother, Connelly Springs, NC (US)

(72) Inventor: Daniel Strother, Connelly Springs, NC (US)

( * ) Notice: Subject to any disclaimer, the term of this patent is extended or adjusted under 35 U.S.C. 154(b) by 0 days.

(21) Appl. No.: 16/158,882

(22) Filed: Oct. 12, 2018

(51) Int. Cl.
*E06B 9/04* (2006.01)

(52) U.S. Cl.
CPC ..... *E06B 9/04* (2013.01); *E05Y 2900/146* (2013.01)

(58) Field of Classification Search
CPC . E06B 9/02; E06B 9/06; E06B 9/0676; E06B 9/04
USPC ..... 52/203
See application file for complete search history.

(56) References Cited

U.S. PATENT DOCUMENTS 127,803 A * 6/1872 Schumann
3,020,951 A * 2/1962 Graulich ..... E06B 9/0669 160/35
6,345,476 B1 * 2/2002 Hill ..... E06B 9/02 160/118
2002/0189770 A1 * 12/2002 Van Hee ..... A47H 23/04 160/210
2004/0035056 A1 * 2/2004 Briscoe ..... E06B 9/02 49/67
2004/0140062 A1 * 7/2004 Lee ..... E06B 9/04 160/117
2004/0187417 A1 * 9/2004 Thomas ..... B44C 5/00 52/311.1
2006/0118356 A1 * 6/2006 Beeson ..... E06B 5/20 181/287
2009/0090062 A1 * 4/2009 Pandorf ..... E06B 9/02 49/50
2009/0183447 A1 * 7/2009 Hay ..... E06B 9/02 52/202

* cited by examiner

*Primary Examiner* — Gregory J Strimbu
(74) *Attorney, Agent, or Firm* — Sanchelima & Associates, P.A.; Christian Sanchelima; Jesus Sanchelima

(57) ABSTRACT

A window shutter for securing windows. The window shutter comprises at least one first shutter and at least one second shutter. The first shutter is coupled to the second shutter via hinges. The first shutter is affixed to a wall and adjacent to a window frame. The second shutter is operable to swing about a pivot axis of the hinges. The second shutter is used to secure windows provided in the window frame.

5 Claims, 8 Drawing Sheets

WINDOW SHUTTER

BACKGROUND OF THE INVENTION

1. Field of the Invention

The present disclosure generally relates to a field of protecting windows. More particularly, the present disclosure relates to a window shutter provided adjacent to a window to protect the window from damage caused to due to extreme weather and other flying objects.

2. Description of the Related Art

It is known that houses and buildings are provided with windows. The windows are provided to allow fresh air into the house and to provide ventilation. Typically, the windows comprise a frame around the window usually called as a window frame. Within the window frame, a transparent or translucent material made up of glass, or opaque material made up wood or sheet metal is provided, which acts as a window. The windows may be opened, to allow ventilation, or closed, to exclude inclement weather. Typically, the windows are provided with a latch or similar mechanism to lock the window shut or to hold it open by various amounts.

As the windows are exposed to weather, the windows may get damaged due to wind, storms, or flying objects. For example, due to the wind, the windows may break and the broken pieces may fall inside the house. Further, burglars may break into the house through the window. Further, dust and other unwanted materials may come inside the house through the window. In order to overcome above problems, generally the windows are provided with shutters. The shutters may be coupled to the window frame and are closed to protect the windows from extreme weather.

Several designs of the window shutters have been proposed in the past. One such example is disclosed in a United States patent application 20060242919. In US20060242919A1, a shutter assembly having at least one shutter and a security bar device for locking closed and providing additional rigidity to the shutter when covering an opening in a dwelling is disclosed.

Another example is disclosed in a United States patent application 20090090062. In US20090090062A1, a combination window frame and panel or shutter door system to provide security to premises and to protect the windows from storm wind damage is disclosed. The frame and shutter door combination is configured to be installed over existing pre-installed windows or configured to be combined as a single window shutter door frame combination to install in window openings on a wall.

Yet another example is a U.S. Pat. No. 9,145,730. In U.S. Pat. No. 9,145,730, security shutters for window and door openings is constructed of a guide rail that is configured to be secured above a door or window opening is disclosed. A left shutter and a right shutter are rollably attached to the guide rail such that the left shutter and/or right shutter are able to slide along the guide rail in order to cover or expose the door or window opening. The left shutter and the right shutter each include at least one roller bracket affixed to a top distal edge, which includes a roller wheel distally located thereto. The roller wheel is nested inside of the guide rail such that the left shutter or right shutter is able to slide along a guide rail length.

Although the shutters disclosed in the prior art are effective in protecting the windows, they have certain problems. The shutter disclosed in US20090090062A1 is installed over existing pre-installed windows or frame. If the windows need to be replaced or to be cleaned, it will be difficult as the shutter comes in the way. Further, the shutter disclosed in U.S. Pat. No. 9,145,730 is constructed of a guide rail that is configured to be secured above the window opening. As the windows are exposed to atmosphere, the guide rails may not work effectively over a period of time. Further, the shutters are difficult to close from inside the house.

Other documents describing the closest subject matter provide for a number of more or less complicated features that fail to solve the problem in an efficient and economical way. None of these patents suggest the novel features of the present invention. Specifically, none of the disclosures in the art disclose a window shutter that is affixed to a wall and adjacent to a window or window frame.

Therefore, there is a need in the art for a window shutter for securing a window, the window shutter is affixed to a wall and adjacent to the window or window frame.

SUMMARY OF THE INVENTION

It is one of the main objects of the present invention to provide a window shutter for securing windows and that avoids the drawbacks of the prior art.

It is one object of the present invention to provide a window shutter for securing windows is disclosed. The window shutter comprises at least one first shutter and at least one second shutter. The first shutter is coupled to the second shutter via hinges. The first shutter is affixed to a wall adjacent to a window frame. The second shutter is operable to swing about its pivot axis with the help of the hinges. The second shutter is used to secure windows provided in the window frame.

It is another object of the present invention to provide a window shutter for securing windows. The window shutter comprising a pair of first shutters and a pair of second shutters. Each of the second shutters is coupled to respective first shutter via hinges. Each of the first shutters is provided adjacent to a window frame and affixed to a wall. Each of the second shutters is operable to swing in opposite rotational directions about respective axes with the help of the hinges. Each of the second shutters is operated to secure windows provided in the window frame.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a window shutter for securing windows. The window shutter comprises at least one first shutter and at least one second shutter. The first shutter is coupled to the second shutter via hinges. The first shutter is affixed to a wall adjacent to a window frame. The second shutter is operable to swing about its pivot axis with the help of the hinges. The second shutter is used to secure windows provided in the window frame.

Various features and embodiments of a window shutter for securing windows are explained in conjunction with the description of FIGS. 1-11.

Figure 1:
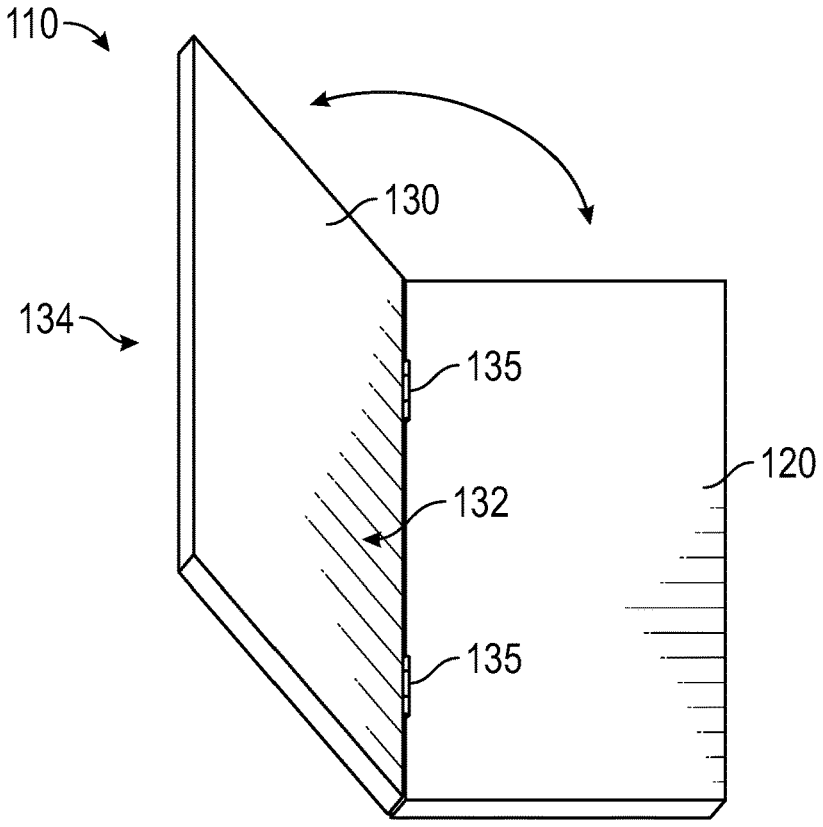
FIG. 1 illustrates a schematic diagram of a first shutter assembly 110, in accordance with one embodiment of the present disclosure.

In accordance with one embodiment of the present disclosure, a window shutter 100 comprising a first shutter assembly 110 and a second shutter assembly 150 for securing windows is disclosed. Referring to FIG. 1, the first shutter assembly 110 is shown. The first shutter 110 comprises a first shutter 120 and a second shutter 130. Each of the first shutter 120 and the second shutter 130 may be made up plastic, wood, metal or any other suitable material. Further, each of the first shutter 120 and the second shutter 130 may be provided in a square or rectangular or any other shape. The first shutter 120 is held firmly and the second door 130 is made to swing at its pivotal axis. In one example, the first shutter 120 and the second shutter 130 are coupled using hinges 135, which facilitates rotation of the second shutter 130 with respect to the first shutter 120. Further, the second shutter 130 comprises a first side 132 and a second side 134. It should be understood that FIG. 1 is provided to illustrate that the first shutter 120 is held firmly and the second door 130 is made to swing at its pivotal axis with the help of the hinges 135.

Figure 2:
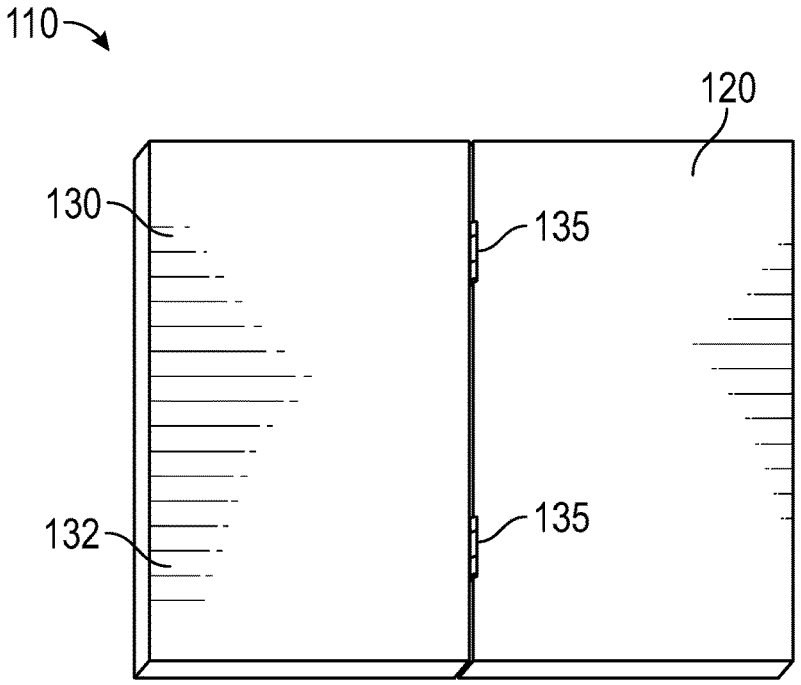
FIGS. 2 and 3 illustrate the first shutter assembly 110 laid out flat, and the first shutter assembly 110 in which a second shutter 130 is placed on top of a first shutter 120, in accordance with one embodiment of the present disclosure.
Figure 3:
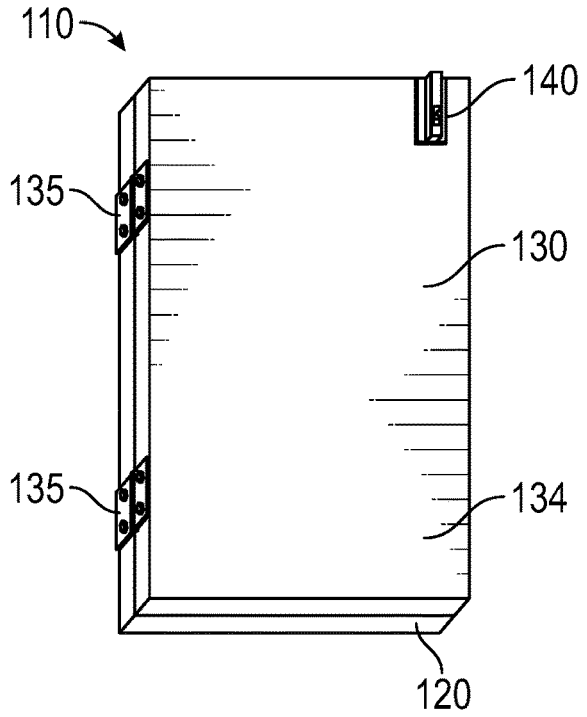

Referring to FIG. 2, the first shutter 120 and the second shutter 130 laid flat is shown. Further, referring to FIG. 3, the second shutter 130 folded to place on the first shutter 120 is shown. As can been seen, the second shutter 130 comprises a first latch 140 at the second side 134. The function of the first latch 140 is explained in later part of the description.

Figure 4:
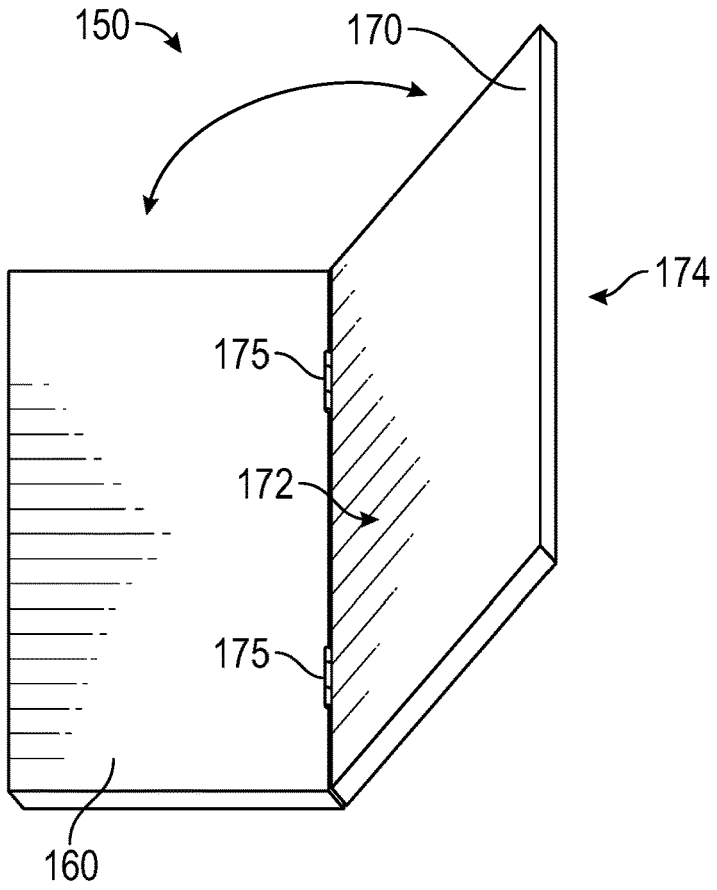
FIG. 4 illustrates a schematic diagram of a second shutter assembly 150, in accordance with one embodiment of the present disclosure.

Now referring to FIG. 4, the second shutter assembly 150 is shown. As can be seen, the second shutter assembly 150 comprises a third shutter 160 and a fourth shutter 170. Each of the third shutter 160 and the fourth shutter 170 may be made up plastic, wood, metal or any other suitable material. Further, each of the third shutter 160 and the fourth shutter 170 may be provided in a square or rectangular shape. The third shutter 160 is held firmly and the fourth shutter 170 is made to swing at its pivotal axis. In one example, the third shutter 160 and the fourth shutter 170 are coupled using hinges 175. Further, the fourth shutter 170 comprises a third side 172 and a fourth side 174. It should be understood that FIG. 4 is provided to illustrate that the third shutter 160 is held firmly and the second door 130 is made to swing at its pivotal axis with the help of the hinges 175.

Figure 5:
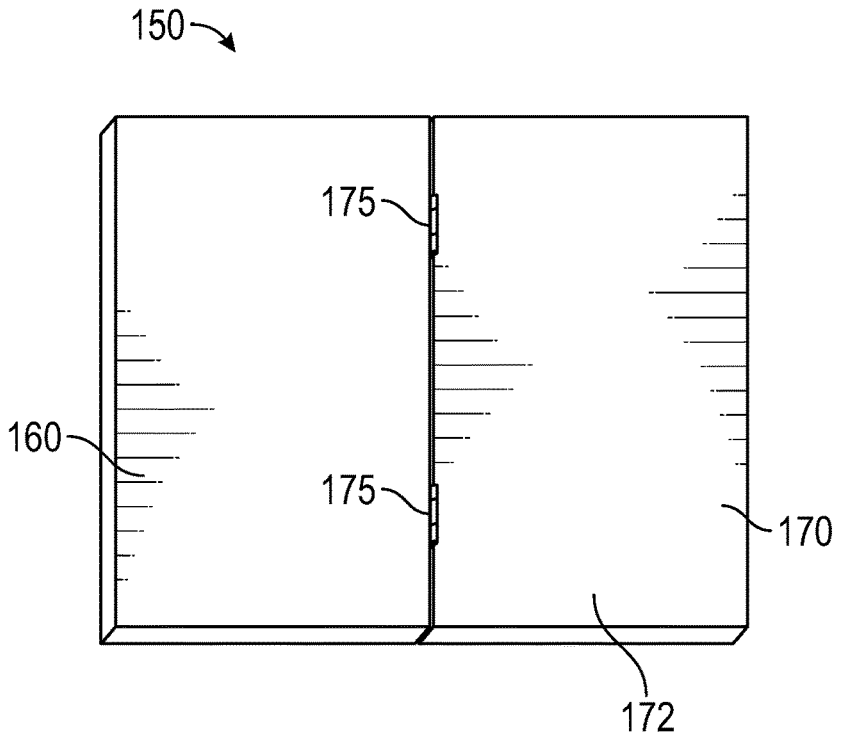
FIGS. 5 and 6 illustrate the second shutter assembly 150 laid out flat, and the second shutter assembly 150 in which a fourth shutter 170 is placed on top of a third shutter 160, in accordance with one embodiment of the present disclosure.
Figure 6:
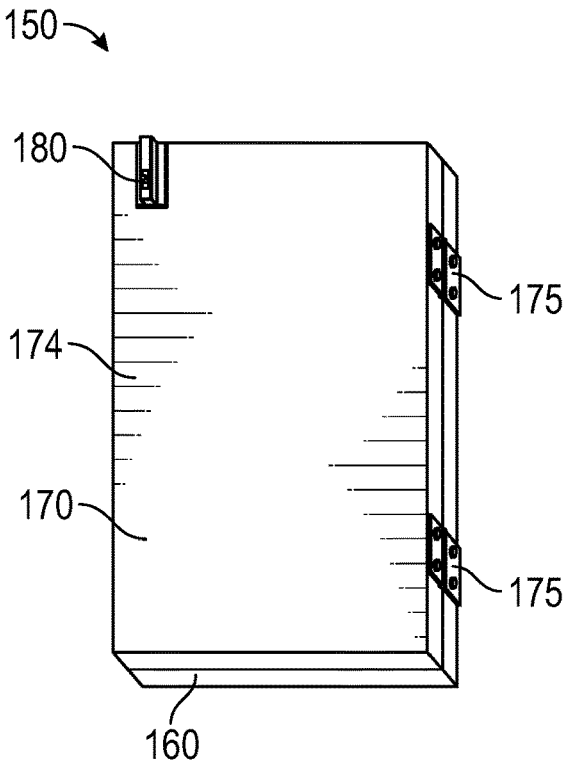

Referring to FIG. 5, the third shutter 160 and the fourth shutter 170 laid flat is shown. Further, referring to FIG. 6, the fourth shutter 170 folded to place on the third shutter 160 is shown. As can been seen, the fourth shutter 170 comprises a second latch 180 at the second side 174. The function of the second latch 180 is explained in later part of the description.

Figure 7:
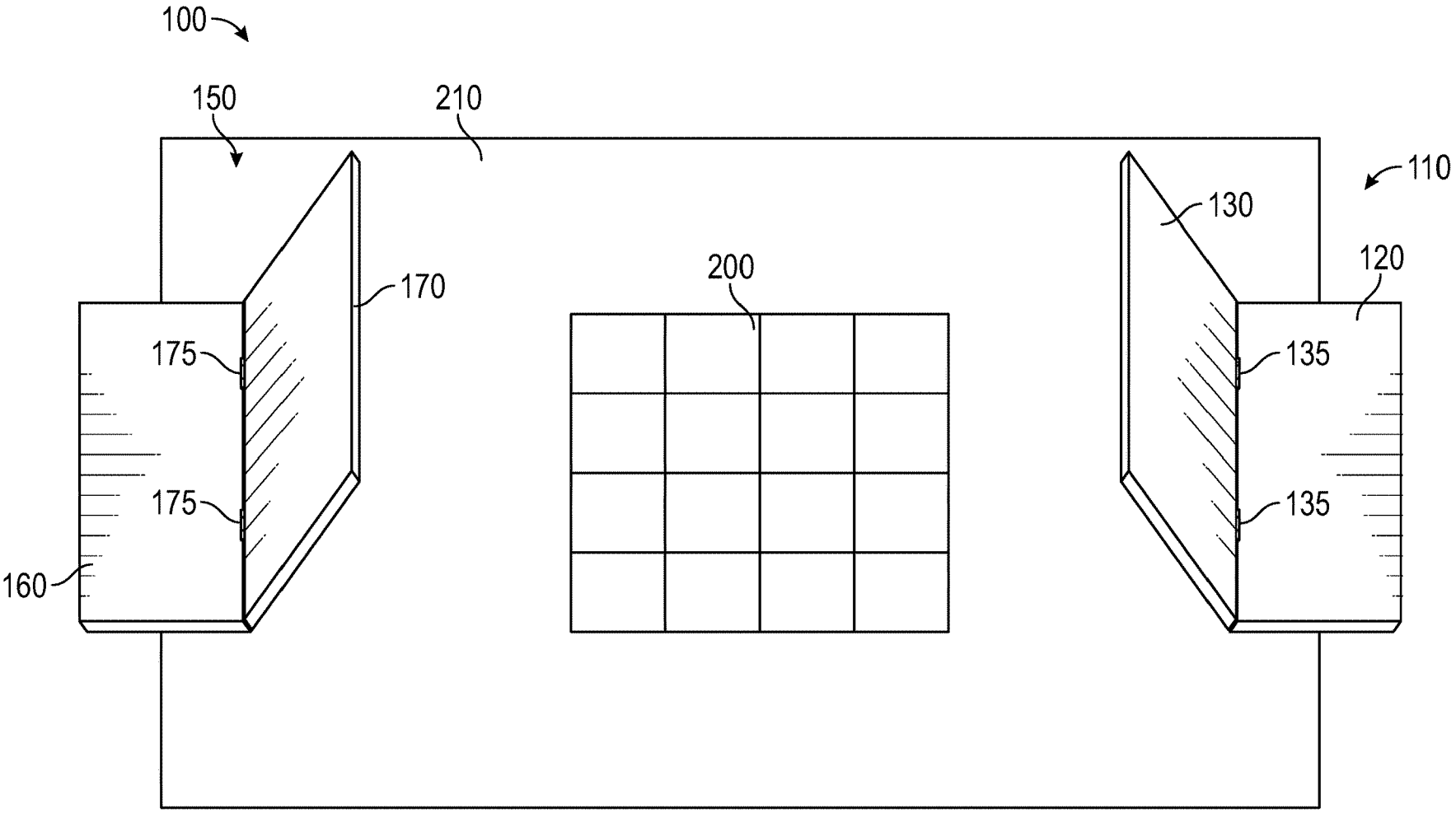
FIG. 7 illustrates an exploded view of a window shutter 100 aligned with respect to a window 200, in accordance with one embodiment of the present disclosure.
Figure 8:
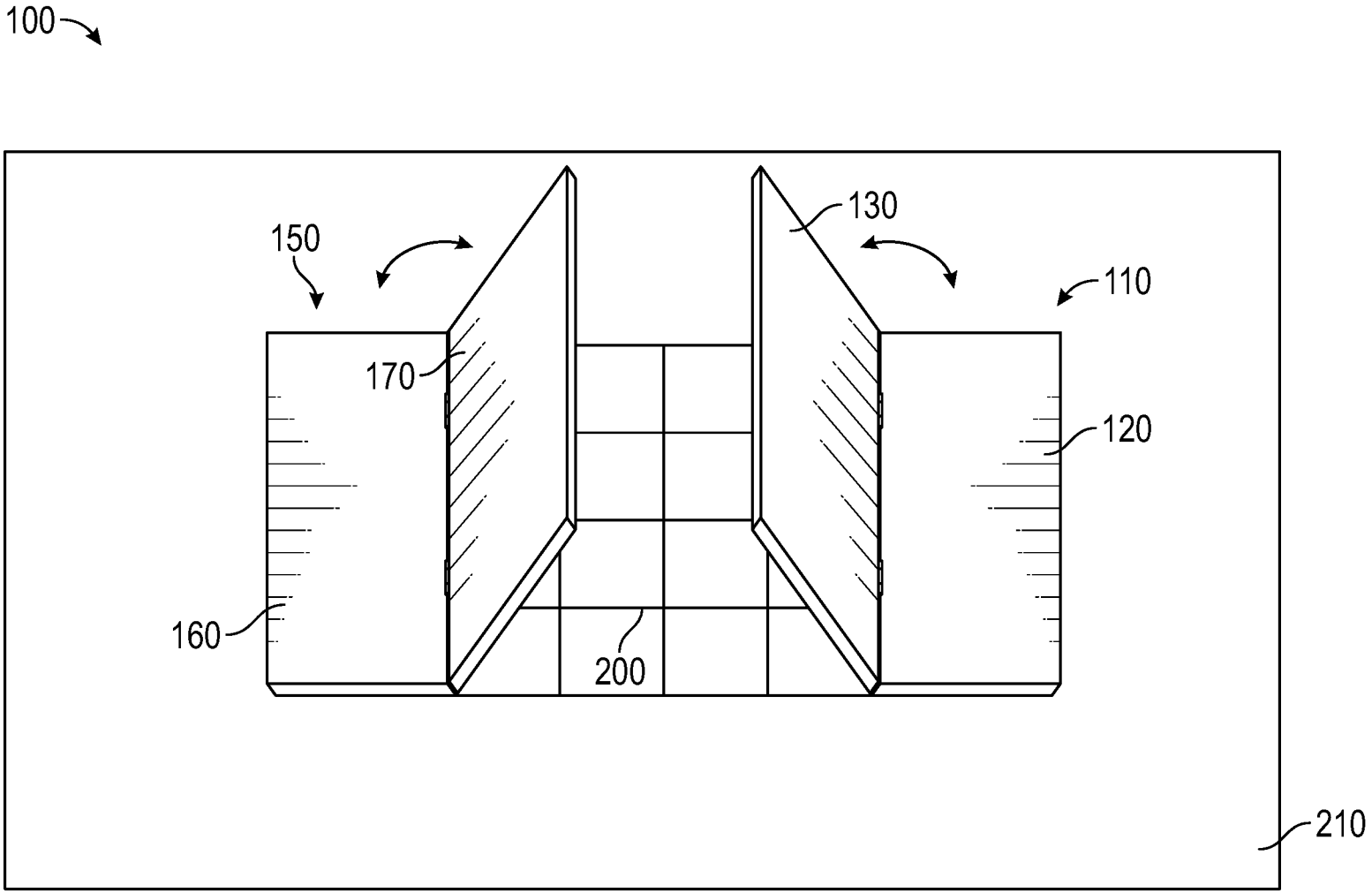
FIG. 8 illustrates the window shutter 100 coupled to a wall 210 adjacent to the window 200, in accordance with one embodiment of the present disclosure.

Now referring to FIG. 7, an exploded view of the window shutter 100 aligned with a window 200 provided at a wall 210 is shown. Further, FIG. 8 shows the window shutter 100 coupled to the wall 210. In order to couple the window shutter 100 to the wall 210, the first shutter assembly 110 is placed adjacent to the window 200. Specifically, the first shutter assembly 110 is placed at adjacent to a window frame (not shown) of the window 200. In order to couple the first shutter assembly 110 to the wall 210, at first, the first shutter 120 is affixed to the wall 210. In one example, the first shutter 120 may be affixed to the wall 210 with the help of fasteners (not shown) or using any other known mechanism. In one example, the first shutter 120 may be provided with shims (not shown) used for coupling the first shutter 120 to the wall 210. The first shutter 120 is coupled to the wall 210 in such a way that when the second shutter 130 is closed i.e., laid flat, the second shutter 130 covers substantially half of the window 200 thereby covering half of the window 200.

Similarly, the second shutter assembly 150 is placed adjacent to the window 200. Specifically, the second shutter assembly 150 is placed at adjacent to a window frame (not shown) of the window 200. In order to couple the second shutter assembly 150 to the wall 210, the third shutter 160 is affixed to the wall 210. In one example, the third shutter 160 may be affixed to the wall 210 with the help of fasteners (not shown) or using any other known mechanism. In one example, the third shutter 160 may be provided with shims (not shown) used for coupling the third shutter 160 to the wall 210. The third shutter 160 is coupled to the wall 210 in such a way that when the fourth shutter 170 is closed i.e., laid flat, the fourth shutter 170 covers substantially half of the window 200 thereby covering half of the window 200.

Figure 9:
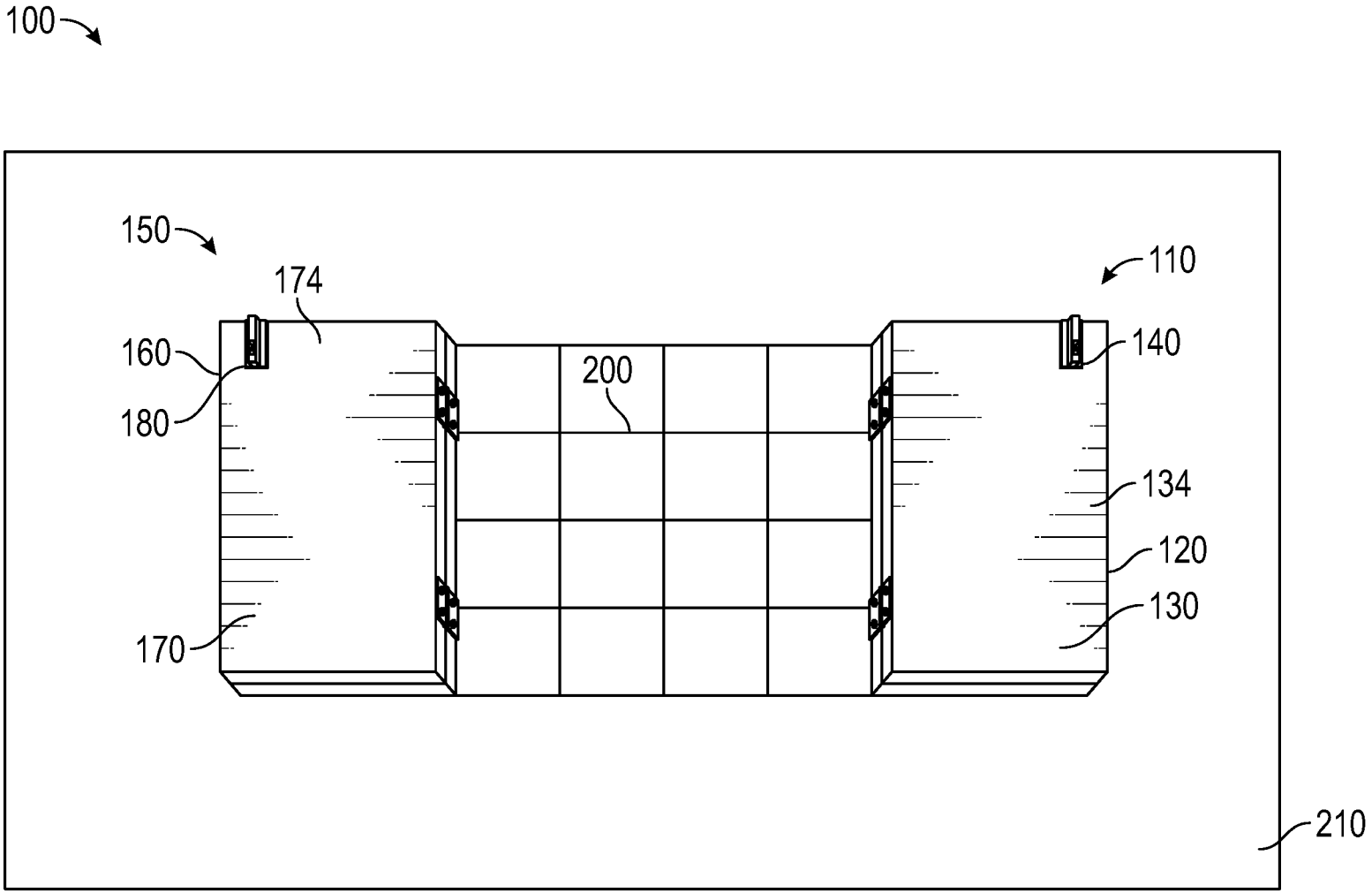
FIG. 9 illustrates the window shutter 100 in open position, in accordance with one embodiment of the present disclosure.

Referring to FIG. 9, the window shutter 100 in open position is shown. In order to open the window shutter 100, the second shutter 130 is made to swing and made to come on top of the first shutter 120. Similarly, the fourth shutter 170 is made to swing and made to come on top of the third shutter 160. The second shutter 130 and the fourth shutter 170 are opened to access to the window 200. Alternatively, the second shutter 130 and the fourth shutter 170 are opened to provide air or ventilation into a house through the window 200.

Figure 10:
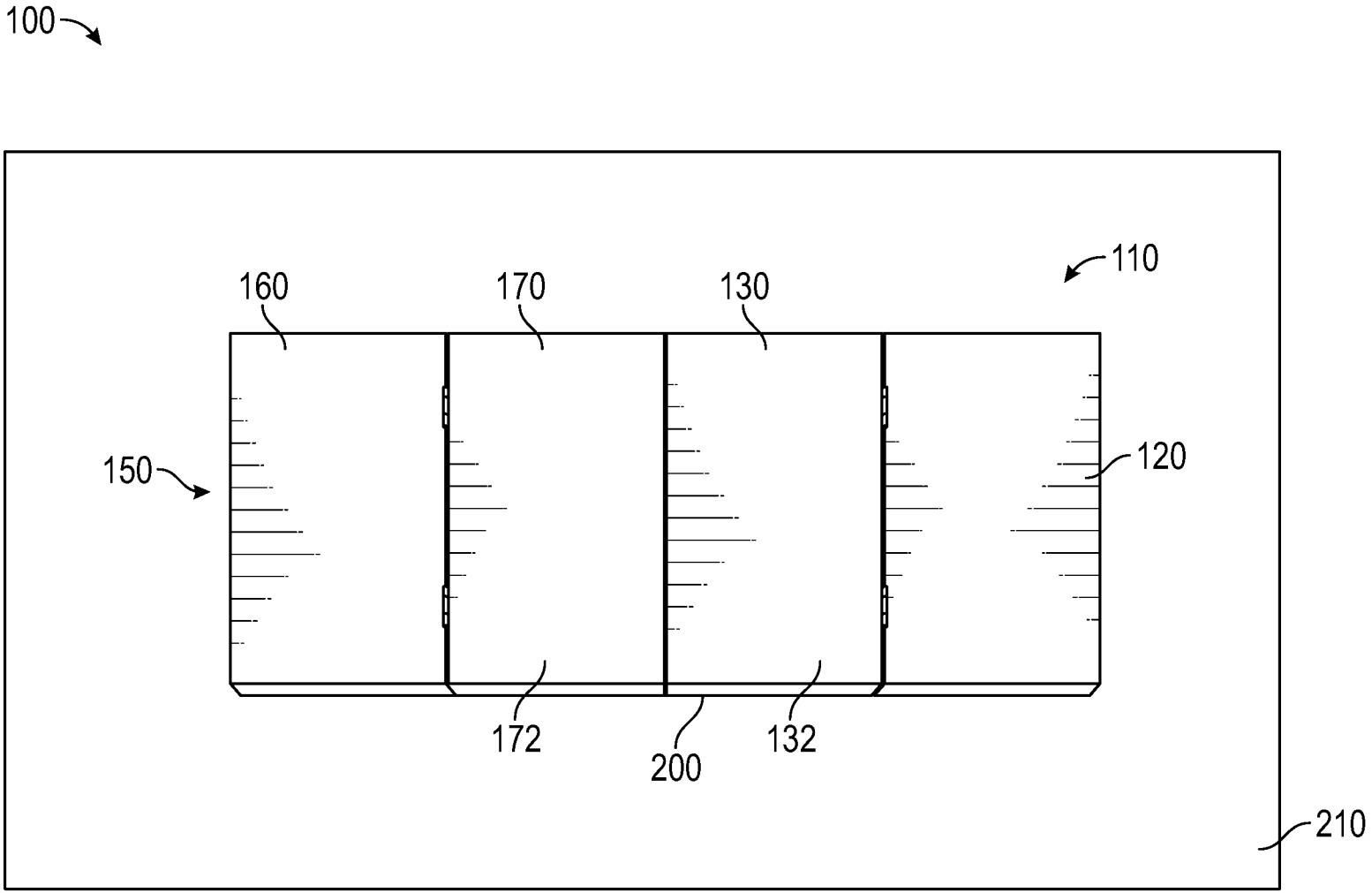
FIG. 10 illustrates the window shutter 100 in closed position i.e., laid out flat, in accordance with one embodiment of the present disclosure.

Referring to FIG. 10, the window shutter 100 in closed position is shown. It should be understood that the window shutter 100 protects the window 100 when in closed position. In order to close the window shutter 100, both i.e., the first shutter assembly 110 and the second shutter assembly 150 are positioned in flat. As explained above, the first shutter 120 is coupled adjacent to the window 200 and the second shutter 130 when laid flat covers substantially half of the window 200. Similarly, the third shutter 160 is coupled adjacent to the window 200 and the fourth shutter 170 when laid flat covers substantially half of the window 200. As such, when the first shutter assembly 110 and the second shutter assembly 150 are laid flat, the second shutter 130 and the fourth shutter 170 cover the window 200.

When the first shutter assembly 110 i.e., the second shutter 130 is in closed position, the second side 134 of the second shutter 130 faces the window 100 or interior of the house. As specified above, the second shutter 130 comprises the first latch 140 at the second side 134. As such, when the second shutter 130 is closed, an occupant of the house may lock the first latch 140 from inside to couple the second shutter 130 to the window 200 or window frame.

Similarly, when the second shutter assembly 150 i.e., the fourth shutter 170 is in closed position, the fourth side 174 of the fourth shutter 170 faces the window 100 or interior of the house. As specified above, the fourth shutter 170 comprises the second latch 180 at the fourth side 174. As such, when the fourth shutter 170 is closed, the occupant of the house may lock the second latch 180 from inside to couple the second latch 180 to the window 200 or window frame.

In one embodiment, both the sides i.e., the first side 132 and the second side 134 of second shutter 130 may be embossed, painted or other applied designs or logos representing commercial establishments or characteristics representative of the occupants as additional decorative impressions.

Similarly, both the sides i.e., the third side 172 and the fourth side 174 of fourth shutter 170 may be embossed, painted or other applied designs or logos representing commercial establishments or characteristics representative of the occupants as additional decorative impressions.

Figure 11:
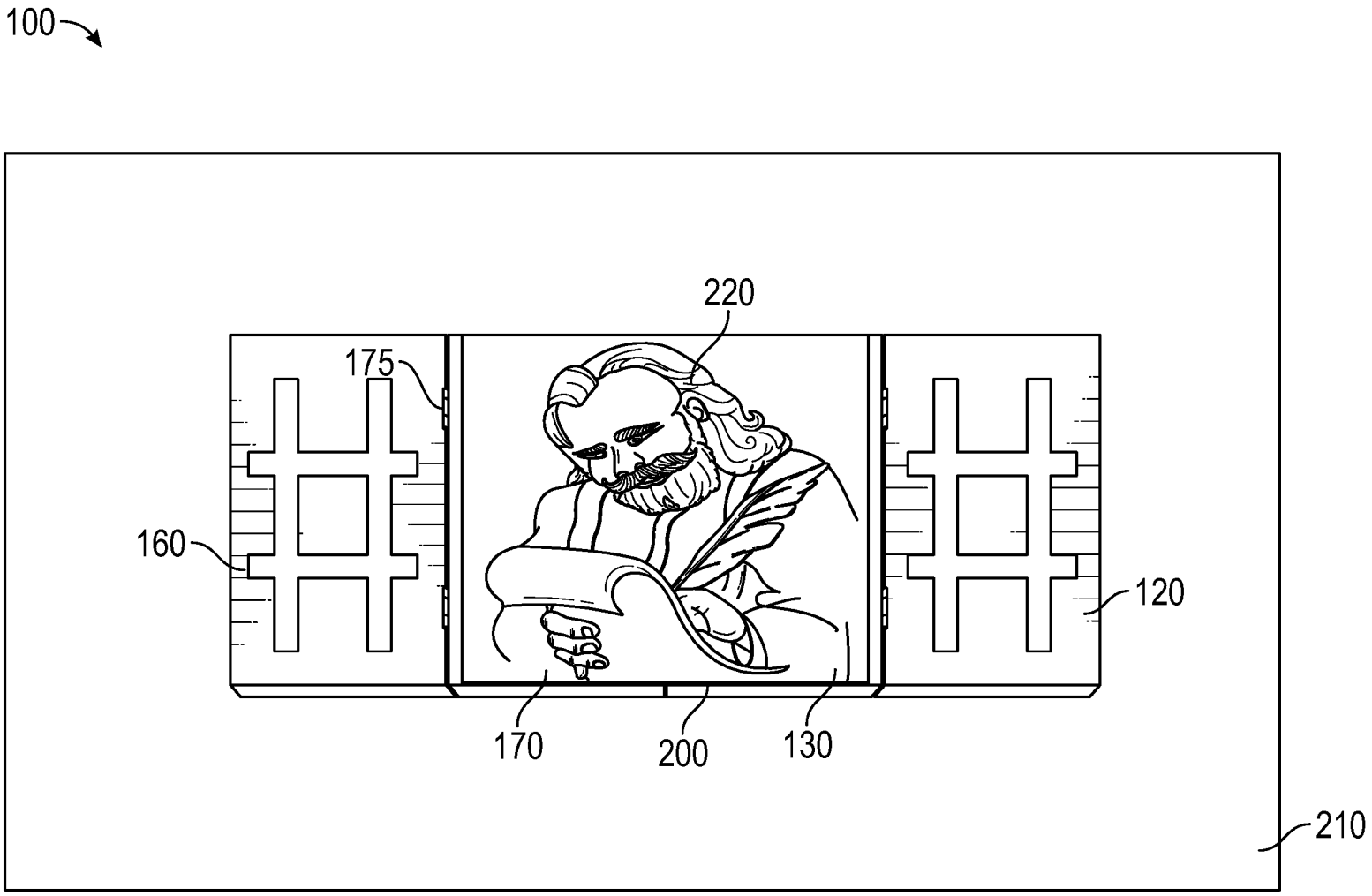
FIG. 11 illustrates the window shutter 100 in closed position i.e., laid out flat, in accordance with one embodiment of the present disclosure.

Referring to FIG. 11, the first side 132 of the second shutter 130 and the third side 172 of the fourth shutter 170 painted or sketched with a picture 220 of Jesus is shown, in accordance with one exemplary embodiment of the present disclosure. Similarly, one or both sides of the second shutter 130, and the fourth shutter 170 may be painted or embossed with different characters or graffiti based on the occupant's desire.

In another example, the first shutter 120, the first side 132 of the second shutter 130 and the third side 172 of the fourth shutter 170, and the third shutter 150 which are facing outdoors may be embossed, painted or other applied designs or logos representing commercial establishments or characteristics as additional decorative impressions.

Although the above description is explained considering two shutter assemblies 110; 150, each affixed adjacent to the window or window frame at both sides, it is obvious to a person skilled in the art to provide a single shutter assembly at only one side of the window with a large shutter (swingable shutter) which can cover the width of the window.

Further, the latch described herein is provided for illustrative purposes, and it is obvious to a person skilled in the art to use other latches or locks for locking the shutter to the window or the window frame. Furthermore, it should be understood that the latches may be provided at both sides of the shutters (second shutter and/or further shutter) so that the user will be able to lock the shutter from inside or outside of the house.

As in the prior art, window shutter is affixed to the window frame and it is difficult to remove and use it with another window. However, the window shutter described herein is coupled to the wall. As such, the window shutter can be removed and affixed to another window without much difficulty.

It should be understood that the window shutter may be made using rigid materials such as metal or wood or plastic based on the need to withstand storms, heavy winds, flying objects, and other objects.

Further, the window shutter described above can be used to provide protection from extreme weather such as storms, heavy wind and so on and flying objects hitting the window. Further, the window shutter can be used as an additional layer of security to the house and can help prevent break-in at the house through the window.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window shutter, comprising:

at least one first shutter, said at least one first shutter being non-movably and fixedly mounted to a wall, said at least one first shutter being adjacent to a window frame in said wall, said window frame having windows therein, said at least one first shutter being in constant abutting contact with said wall; and at least one second shutter coupled to the first shutter via hinges, said at least one first shutter and said at least one second shutter being identical in dimensions, wherein only the at least one second shutter is operable to swing about a pivot axis of the hinges, said at least one second shutter having an open configuration and a closed configuration, said at least one second shutter being directly stacked atop of said at least one first shutter in said open configuration creating a double stacked structure, said at least one second shutter rotating away from said at least one first shutter to achieve said closed configuration where the at least one second shutter is used to protect the windows provided within the window frame by covering said windows, said at least one second shutter rotating towards said at least one first shutter to achieve said open configuration and, wherein said at least one first shutter and said at least one second shutter each include a show surface, wherein said show surfaces face each other when the second shutter is in the open configuration and said show surfaces are visible when the second shutter is in the closed configuration.

2. The window shutter of claim 1, wherein the at least one second shutter includes a latch used for locking the second shutter to the window.

3. The window shutter of claim 2, wherein said latch is located on a top portion of said at least one second shutter.

4. The window shutter of claim 1, wherein the at least one first shutter is coupled to the wall using fasteners.

5. The window shutter of claim 1, wherein said at least one first shutter and said at least one second shutter are flush with one another when the second shutter is in the open configuration.

* * * * *